US008215569B2

(12) United States Patent
Johnson

(10) Patent No.: US 8,215,569 B2
(45) Date of Patent: Jul. 10, 2012

(54) LAMINAR FLOW WATER JET WITH ILLUMINATION ENHANCER

(76) Inventor: Bruce Johnson, Parkland, FL (US)

( * ) Notice: Subject to any disclaimer, the term of this patent is extended or adjusted under 35 U.S.C. 154(b) by 506 days.

(21) Appl. No.: 12/461,624

(22) Filed: Aug. 18, 2009

(65) Prior Publication Data

US 2011/0042489 A1 Feb. 24, 2011

(51) Int. Cl.
*F21S 8/00* (2006.01)

(52) U.S. Cl. ..... 239/18; 239/17

(58) Field of Classification Search ..... 239/16, 239/17, 18, 22, 398, 419.5, 425.5, 428.5, 239/468

See application file for complete search history.

(56) References Cited

U.S. PATENT DOCUMENTS 5,160,086 A * 11/1992 Kuykendal et al. ..... 239/18
5,641,120 A * 6/1997 Kuykendal et al. ..... 239/18
6,053,423 A * 4/2000 Jacobsen et al. ..... 239/18
7,264,176 B2 * 9/2007 Johnson ..... 239/22
7,775,457 B2 * 8/2010 Schnuckle ..... 239/12

* cited by examiner

*Primary Examiner* — Davis Hwu
(74) *Attorney, Agent, or Firm* — Tangrent Law Group, PLLC; Eric J. Weierstall, esq.

(57) ABSTRACT

A laminar flow water jet having a housing with a water channel flowing there through. An at least one water input admits water into the housing and the water channel. An at least one filter member is provided along the water channel. An at least one jetting element in communication with the housing and jets a laminar flow tube or segment from the jet. An at least one lighting element emits light and communicates with the laminar flow tube or segment. An at least one additive supply element communicates with the at least one laminar flow tube or segment, where a laminar water flow is jetted through the at least one jetting element to form the laminar flow tube or segment which is lit by the light emitted by the at least one lighting element and receives an additive stream from the at least one additive supply element to produce wave effects within the laminar flow tube or segment.

16 Claims, 3 Drawing Sheets

LAMINAR FLOW WATER JET WITH ILLUMINATION ENHANCER

BACKGROUND

1. Field of the Invention

The invention relates to a water feature, specifically a laminar flow water jet lighting apparatus and method.

2. Background of the Invention

It is often desired to utilize a fluid, such as water, as part of a display or attraction. Increasingly, the popularity of using water attractions as an integral part of domestic and commercial landscaping has moved architects and landscapers to push further and further into incorporating the decorative aspects of these water features. These features are incorporated through swimming pools, spas, ponds, lakes fountains that adorn public and private plazas, parks, advertisements, and amusement parks and other water features and sources in the typical property.

Lighted laminar flow jets have become popular water features both in commercial fountains and residential swimming pools. The reason for their popularity is the ability to jet and light up glass-like rods of laminar water flow streams or segments of water. Unfortunately, in most cases the overall effect is somewhat diminished due to the extreme clarity of the stream in a laminar water flow stream or segment. Much of the light is simply transferred to the body of water instead of radiating off the sides of the stream. This tends to disappoint the end user as the light is not intense enough or does not achieve the desired aesthetic.

Some manufacturers have used stream interrupters, "thumpers", and "scratchers" to try and help radiate the light by disturbing the nature laminar water flow stream. Each of these methods has some effect, but none provides for an ability to completely light up the entire laminar water flow stream or segment. For example, the stream interrupters and "thumpers" interrupt the flow with a distinct and limited disruption. An example of this can be seen in applicant's co-pending U.S. patent applications Ser. Nos. 11/280,430 and 11/280,392, incorporated herein by reference. These types of devices provide bursts of light, particularly at the point of aberration in the laminar flow water stream, but not continual light within the laminar flow water stream or segment with sufficient luminescence.

Similarly, a typical "scratcher" device uses a screw or pin that touches the laminar water flow stream and disrupts the laminar flow along the surface of the laminar water flow stream, cutting it in halves or significantly separating the tube. This disturbance helps radiate the light, but has only limited light output effect. The stream will light up better in the first half of the stream, but is completely devoid of light in the second half. The "scratchers" and thumper devices also have a negative impact on the quality of the laminar stream, interrupting the glass like structure of the laminar water flow stream and ruining the aesthetic appearance.

The instant invention provides an apparatus and method that resolves the enumerated issues, is easy to manufacture and is cost effective to produce. The device provides for improved radiating light within a laminar flow tube and does so without significant disruption to the appearance and structure of the laminar flow tube.

SUMMARY OF THE INVENTION

An object of the instant invention is to provide an improved lighting apparatus and method for lighting a laminar flow tube or segment so as to provide improved luminescence within the tube and improved radiance.

An further object of the instant invention is to provide a cost-effective lighting apparatus and method for lighting a laminar flow tube or segment so as to provide for improved intensity and aesthetic features while significantly maintaining the overall laminar water flow tube or segment structure.

A still further object of the instant invention is to provide a cost effective lighting apparatus and method of lighting a laminar flow tube or segment that provides for improved lighting within the laminar water flow tube or segment structure.

BRIEF DESCRIPTION OF THE DRAWINGS

Embodiments of the invention are explained in greater detail by way of the drawings, where the same reference numerals refer to the same features.

DETAILED DESCRIPTION OF THE INVENTION

Figure 1:
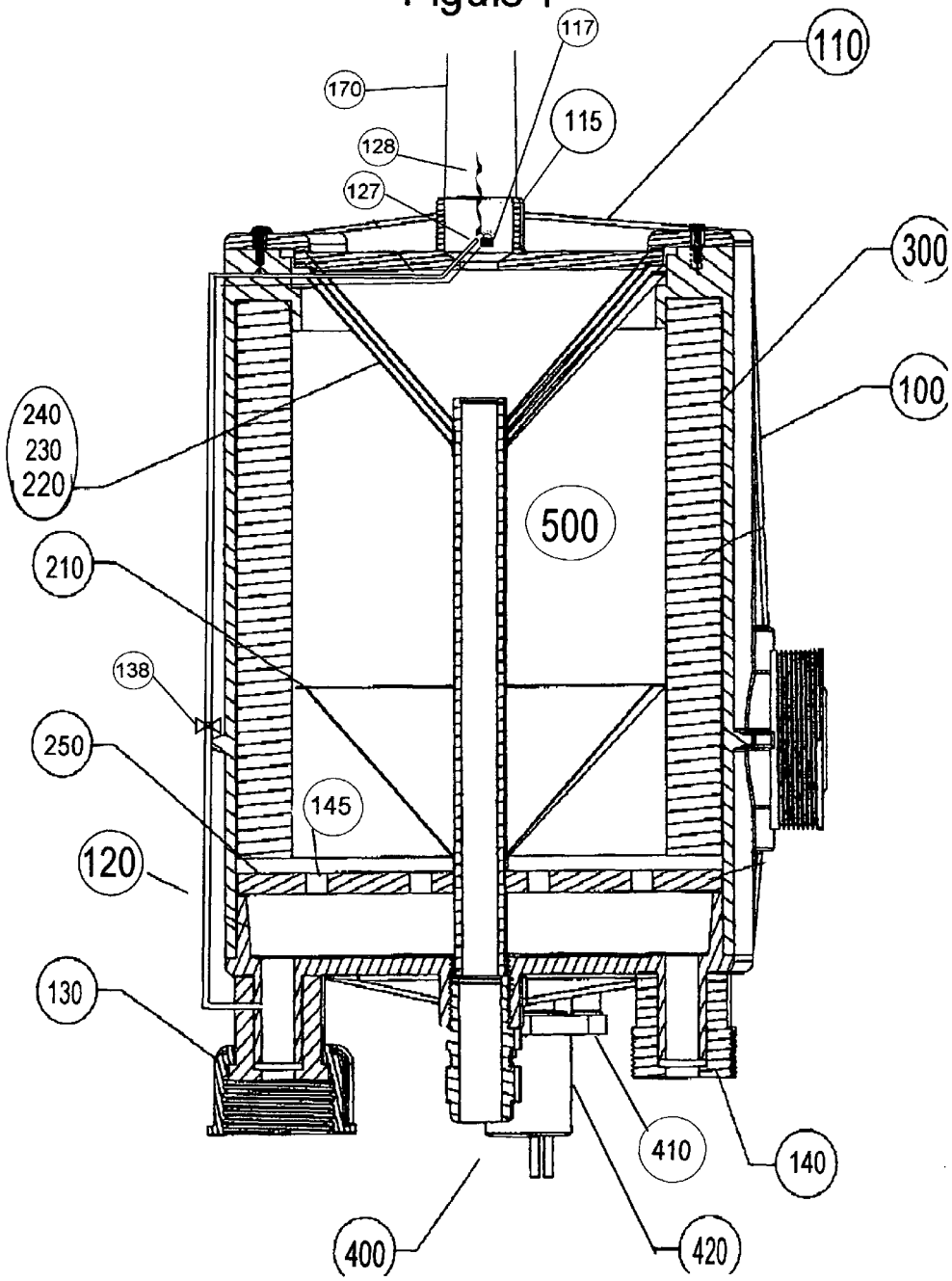
FIG. 1 shows a cross-sectional view of an exemplary embodiment of the instant invention.

FIG. 1 shows a cross sectional view of the exemplary embodiment of the instant invention. The exemplary embodiment comprises a housing 100, a housing top 110 with an at least one jet outlet 115 extending there through, and a housing base 120. Flowing into the housing base 120 is an at least one water input, in this instance a first water input 130 and a second water input 140. Within the housing 100 a laminar water flow channel 500 resides.

In the exemplary embodiment shown, internal to the housing 100 and the laminar water flow channel 500 flows from the plurality of inputs 130, 140, into an at least one baffle member 250 with a plurality of orifices 145 situated therein. Alternatively, the baffle member may be omitted from further exemplary embodiments. Above the plurality of inputs 130, 140 shown, an at least one filter member, in this case a plurality of screens, is provided.

A first filter member 210 is provided in the laminar water flow channel 500 of the exemplary embodiment show in approximately the middle of the housing chamber. Variations in the placement, the positioning, the spacing, the shape, the size, and the number of members or screens can be provided alone or in conjunction with variations in sizes, density, construction, shapes, mesh size, screen gauge, and other variables to suit the particular design constraints of a further exemplary embodiment without departing from the spirit of the invention. Surrounding the interior of the housing 100 is an at least one pliant member 300 through which the laminar water flow channel 500 passes.

Pliant member 300 aids in damping vibrations within the water and absorbing expansions or surges in the water flow as it passes through the laminar water flow channel 500. Particularly pliant member 300 aids in mitigating pump surges and similar pressure variances by absorbing the expansion, as well as aiding in improving the laminarity in the water flow. The at least one pliant member 300 may also be incorporated, in combination with the pliant member shown around the housing or alone, into an at least one of the at least one filter members.

In the exemplary embodiment shown, in addition to the first filter 210 the at least one filter member includes a further series of three filter members 220, 230, 240 above the first filter member 210, which helps provide additional laminarity to the water as it flows towards the at least one jet outlet 115. The additional filter members 220, 230, 240 are also shown as conical in shape. However, it should be understood by one of ordinary skill in the art that the variations in geometry, number, and placement/spacing of the filter members are within the spirit of the invention. Additionally, as mentioned the at least one pliant member 300 can include an at least one pliant member mounted on or within an at least one of the at least one filter members or outside the housing.

In addition to the laminar flow jet housing 100, a control package 400 is provided on the exterior of the housing 100. As depicted in the exemplary embodiment the control package 400 is provided as a microprocessor controller 410 and a solenoid 420. The control package 400 provides a variable timed input to produce a controlled pressure variance or pulse wave within the laminar water flow channel 500.

This can be accomplished in any number of ways, in the exemplary embodiment, the solenoid 420 "thumps" or mechanically strikes the sides of the housing to produce the pressure wave within the laminar water flow channel 500. This is done in the exemplary embodiment shown by the solenoid 420 striking the exterior of the housing 100. Additional methods of providing the control variable pulse within the water flow may be utilized, for example the components of the package can be made to include digital electronic, analog electronic, electro-mechanical, or mechanical components suitable for producing a controlled input, such as a mechanical striking mechanism with a motor and clocks, an inline water wheel that driven by the incoming water flow, a return drip system that strikes the laminar water flow channel, sonic devices, electromechanical striking devices and similar components that can provide a metered pulse wave to interrupt the laminar jet. The control package 400 can comprise additional components and may alternatively be comprised of all solid state components, all electrical components, or any suitable combination therein to provide the necessary resonance or "thump" to create the pressure wave on or in the laminar water flow channel 500.

In the exemplary embodiment, the solenoid 420 is controlled by the microprocessor 410 and may be timed to suit a desired application. For instance, the microprocessor 410 may time the impulse from the solenoid 420 to music. Alternative control inputs can include, but are not limited to, timed circuits, sensors, motion sensors, sound sensors, light sensors, and similar control inputs. Additionally, the controller 400 may be controlled by a master controller (not shown) that controls additional features or accessories. The controller may also include a wireless controller or master controller. The controller, through the pulse wave, interrupts the laminar tube of the laminar water jet, producing a segmented laminar water jet. The timing of the pulses and the length of the jet can thus be controlled to provide a wide number of variations in the shape and size of the laminar jets. Additionally, the interruptions in the laminar water tube issuing from the jet can result in a pleasing multi-colored water effect.

As the water passes through the housing 100, it is smoothed by the elements contained therein and the resulting laminar water flows through the laminar flow water channel 500 toward the housing top 110. The laminar flow water is then jetted our the at least one jet outlet 115. At the at least one jet outlet 115 an at least one lighting device 117 is provided, herein for the sake of clarity shown as a single outlet and corresponding lighting device 117. However, the invention is certainly not limited to a single outlet or lighting device. The lighting device 117 may utilize any appropriate lighting system, including but not limited to, conventional incandescent, halogen, fiber optic, LED or similar lighting systems. The light may be provided at this point or reflected or conveyed to this point. Furthermore, any appropriate manner of focusing the lighting system or focusing elements may be used.

An at least one additive supply element 127, in the exemplary embodiment a single pressurized water supply element, provides a small, slow and controlled stream of pressurized water to the laminar flow water stream 170 at the outlet jet 115. Additional embodiments may utilize different liquids, gasses, or materials without departing from the spirit of the invention. The pressure and volume of the additive supply stream being issued from the additive supply element 127 can be controlled or preset. It can be adjusted accordingly, depending on, for instance, the type of additive and the source of supply or similar variables. In the exemplary embodiment shown, the additive supply element 127 utilizes a small amount of pressurized water that is positioned at the base of the laminar flow water stream 170.

The additive stream 128 is placed in a position close to the at least one jet outlet 115. The additive stream 128, herein described as an additive stream of water for this exemplary embodiment, is slowly pressurized, in this exemplary embodiment using the existing water and pressure within the laminar device, via a valve 138. In other embodiments, other media, such as air, can be pressurized externally or internally utilizing conventional pressurizing devices or mechanisms without departing from the spirit of the invention. The additive stream of water is drawn through capillary action into laminar water flow jet or segment 170 as it is issued from the housing 100 through the at least one jet outlet 115.

The effect within the laminar flow water jet or segment 170 is to induce continual light radiating wave effects down the entire length of the flow water jet or segment 170 through the admission of the additive stream 128. This can be done, as noted above, through the an additive stream of liquid or gas and generally makes for minutely visible aberrations within the laminar tube, for instance a ripple or wave effect within the tube and/or small air bubbles within the tube.

In an exemplary embodiment, the admission of water into the tube as an additive stream produces a capillary action which can produce either a combination of wave effect ripple with air bubble or either singularly. Specifically, the addition of the water draws in the air and creates the effect. The additive stream can be pressurized to enhance the effect or can be simplified to simply use the capillary action only. A high intensity light can then be evenly radiated throughout the entire stream due to the refraction and reflection within the tube by the wave effects imparted by the additive stream 128 for a substantially greater length along the tube than in any heretofore know laminar flow water jetting apparatus. The length of the light can be extended based on scale and size of the streams, but a non-limiting example can produce a single tube laminar flow water jet with a brightly lit laminar flow water jet tube about up to seven feet high and about up to eight feet out into the body of water. The effect is intense, much more pleasing to look at and the truly completes the advertised effect without significant disruption of the laminar flow stream 170.

Figure 2:
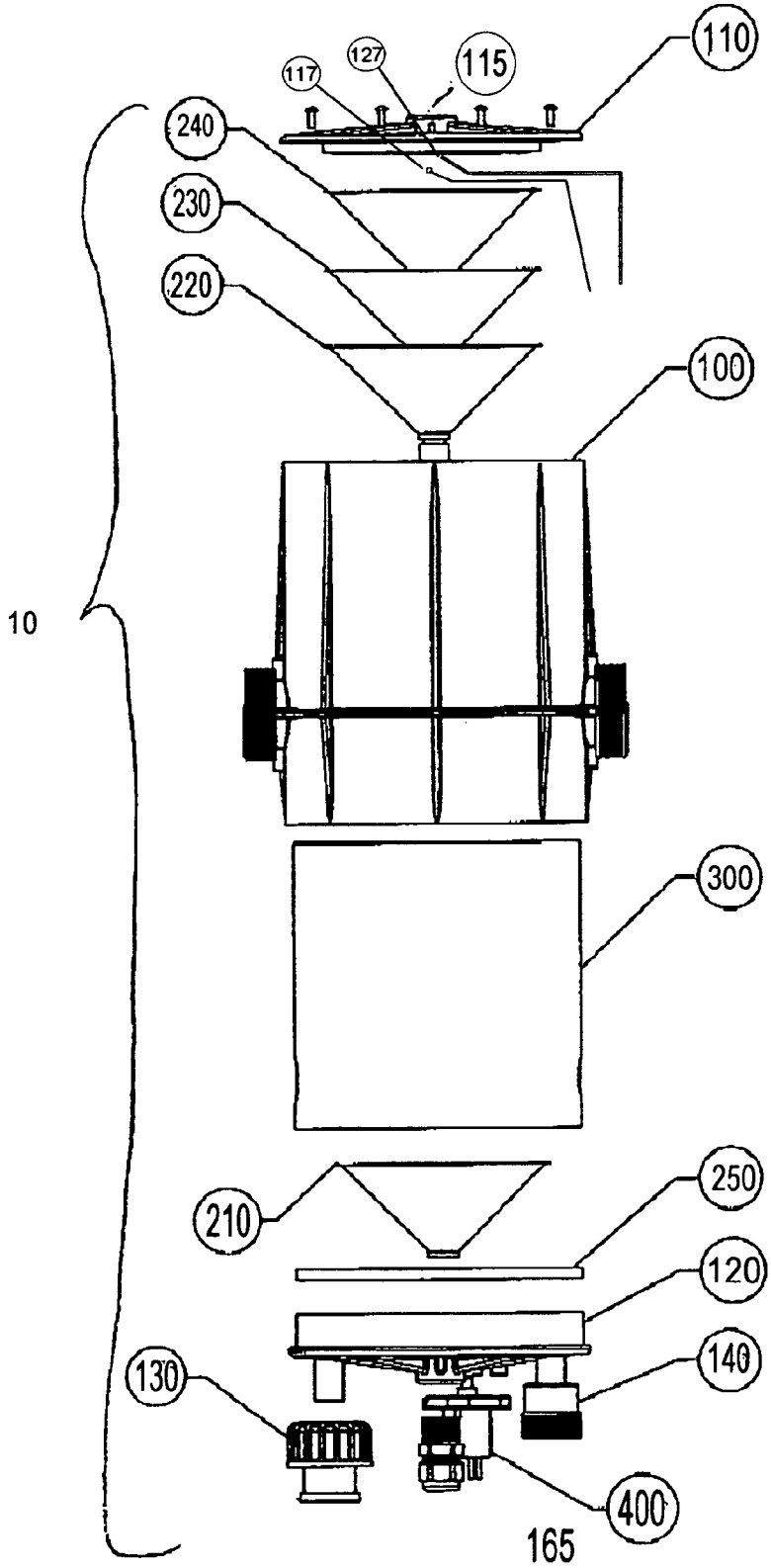
FIG. 2 shows an exploded view of an exemplary embodiment of the instant invention.

FIG. 2 shows an exploded view of the embodiment of FIG. 1. Again within housing 100, of the laminar jet 10, the housing top 110 is provided with a jet 115 protruding there through and an at least one lighting element 117 and an at least one additive supply element 127. Housing base 120 is provided with a common water inlet chamber 130 fed by an at least one water inlet, in the exemplary embodiment shown a first water inlet 130 and second water inlet 140.

Figure 3:
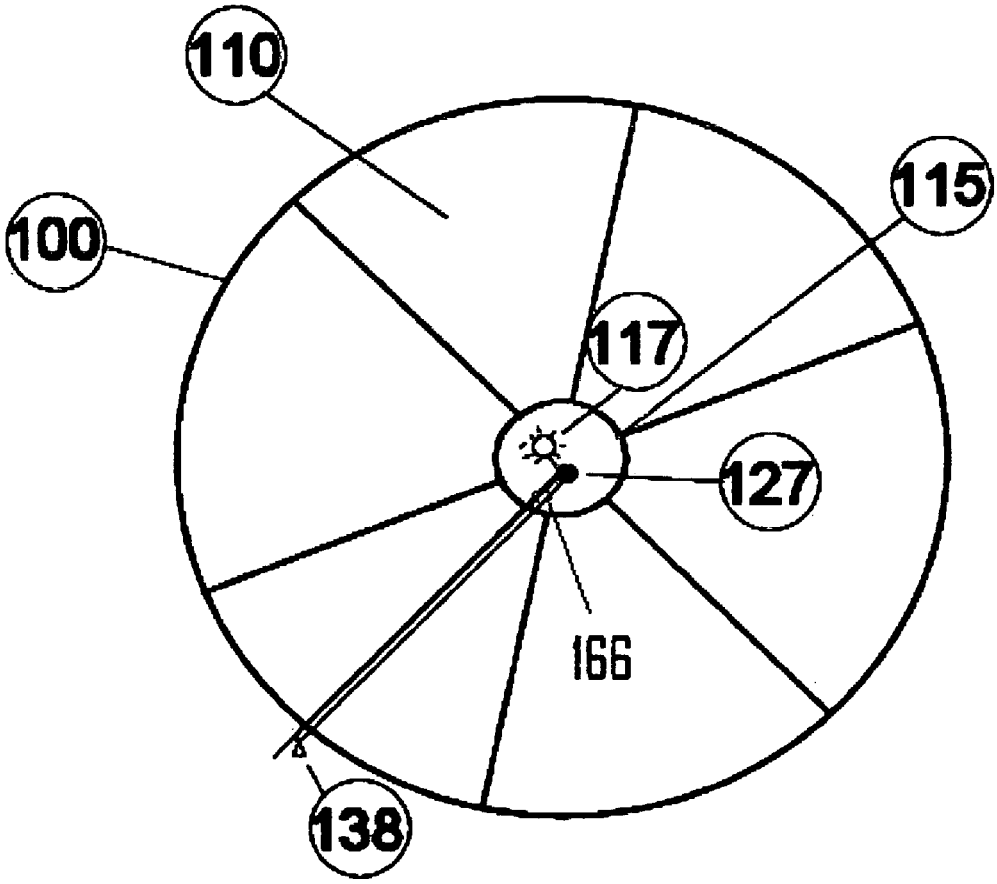
FIG. 3 shows a top down view showing a further exemplary embodiment of the instant invention.

FIG. 3 shows a top down view showing a further exemplary embodiment of the instant invention. In the exemplary embodiment shown, similar to the embodiment of FIG. 1, the housing 100 is provided a housing top 110 with an at lest one jet outlet 115 having the at least one lighting element 117 and the at least one additive supply element, thereon. Here again shown as a single outlet with a single lighting element, the lighting element is located atop the housing top 115. Again, an additive supply element 127 is provided. Again, in the exemplary embodiment shown, a pressurized additive water supply element provides a small, slow and controlled stream of pressurized water to the laminar flow water stream at the outlet jet 115. The use of pressurized air would follow the same paths to introduce the additive stream 128 to the laminar water flow jet or segment 170. Again, additional embodiments may utilize different liquids, gasses or materials, without departing from the spirit of the invention. The pressure and volume of the additive supply stream 128 being issued from the additive supply element 127 can be controlled or preset. It can be adjusted accordingly, depending on the type of additive and the source of supply. In the exemplary embodiment, the additive supply element 127 utilizes a small amount of pressurized water that is positioned at the base of the laminar stream as it exits the housing top 110.

The additive stream 128 is placed in a position close to the at least one jet outlet 115. The additive stream, herein again described as an additive stream of water for this exemplary embodiment, is slowly pressurized, in this exemplary embodiment using the existing water and pressure within the laminar device via a valve #. In other embodiments, other media, such as air, can be pressurized externally or internally utilizing conventional pressurizing devices or mechanisms without departing from the spirit of the invention. The additive stream of water is drawn through capillary action into laminar water flow jet or segment 170 as it is issued from the housing 100 through the at least one jet outlet 115.

In the embodiment shown in FIG. 3, the lighting element and additive supply element 127 are exterior to the housing 100 and are located in such a way as to minimize disruption to the laminar flow tube structure being jetted from the device. The laminar flow tube structure remains substantially like a glass rod. The additive stream 128 and the minor disruption of the elements does not effect the overall look of the laminar flow tube being jetted except to provide the aforementioned wave effect within the tube. This effect is principally internal to the laminar flow tube or segment that has been jetted, providing continual light radiating wave effects down the entire length of the flow water jet or segment 170 through the admission of the additive stream 128. Similar variations to the placement and positioning of the at least one lighting element 117 and at least one additive supply element 127 relative to the laminar flow tube so as to admit the additive stream 128 to laminar water flow jet or segment 170 at points in its creation and ejection can be made without departing from the spirit of the invention.

In addition, the control package 400 and microprocessor controller 410 can control the at least one light element 117 so as to coordinate light changes with segmentations of the laminar flow water tube, through, for example, control of the ejection of the lighted laminar water flow jet or segment 170 turning it on or off and adjusting color in response to a control input. Further, the coordination of light changes with segmentation can be provided through the solenoid 420 and the thumped segmentation or a similar segmenting apparatus. The additive stream 128 providing lighting to the laminar flow water jet or segment in response to the control and changing coloration upon instruction from the controller 410.

The embodiments, exemplary embodiments, and examples discussed herein are non-limiting examples of the invention and its components. The invention is described in detail with respect to exemplary embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention The device may also include an adjustment mechanism 166 that has the ability to control admission of the additive stream and thereby control the length or intensity of the light throughout the stream. Similarly the additive element may be located such that admits the additive stream into the laminar flow tube without disturbing the integrity of the stream itself, maintaining the laminar flow tubes glass like rod structure.

The invention is described in detail with respect to preferred embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed:

1. An apparatus comprising:

a housing with a water channel flowing there through;

an at least one water input admitting water into the housing and the water channel;

an at least one filter member;

an at least one jetting element in communication with the housing and jetting an at least one laminar flow tube or segment;

an at least one lighting element emitting light and communicating with the at least one laminar flow tube or segment; and an at least one additive supply element communicating with the at least one laminar flow tube or segment, wherein a laminar water flow is jetted through the at least one jetting element to form the at least one laminar flow tube or segment which is lit by the light emitted by the at least one lighting element and receives an additive stream from the at least one additive supply element to produce wave effects within the laminar flow tube or segment.

2. The apparatus of claim 1, wherein the additive supply stream is one of a liquid or gas pressurized and admitted by the at least one additive supply element.

3. The apparatus of claim 2, wherein the additive supply stream is pressurized water.

4. The apparatus of claim 2, wherein the additive supply stream is pressurized air.

5. The apparatus of claim 3, wherein the wave effects are produced by capillary action of the additive supply stream of water in the laminar flow tube or segment.

6. The apparatus of claim 4, wherein the additive supply stream of pressurized air causes wave effects in the form of small bubbles within the laminar flow tube or segment.

7. The apparatus of claim 1, wherein the at least one additive supply element is contained at least in part within the housing.

8. The apparatus of claim 1, wherein the at least one additive supply element is outside the housing.

9. The apparatus of claim 1, wherein the at least one lighting element is contained at least in part within the housing.

10. The apparatus of claim 1, wherein the at least one lighting element is outside the housing.

11. The apparatus of claim 1, further comprising a controller and a control input, wherein the controller is in communication with the at least one lighting element and changes the color emitted by the at least one lighting element in response to the control input.

12. The apparatus of claim 11, wherein the controller changes the color emitted by the at least one lighting element in response to a control input in conjunction with a segmenting apparatus that segments the at least one laminar flow tube into discrete segments.

13. The apparatus of claim 1, further comprising an at least one pliant member wherein the pliant member surrounds an interior of the housing.

14. The apparatus of claim 1, further comprising an adjustment member that permits for easy adjustment of the additive stream pressure.

15. The apparatus of claim 1, wherein the at least one additive supply element is a needle valve and the additive stream is a stream of water being pumped through the valve into the laminar flow.

16. The apparatus of claim 1, wherein the at least one additive supply element is located protrudes from within the housing and the laminar flow tube forms around the additive supply element.

* * * * *